US011066260B2

(12) United States Patent
Zaitsu et al.

(10) Patent No.: US 11,066,260 B2
(45) Date of Patent: Jul. 20, 2021

(54) SHEET LOADING DEVICE AND IMAGE FORMING APPARATUS INCORPORATING THE SHEET LOADING DEVICE

(71) Applicants: Daikai Zaitsu, Kanagawa (JP); Junichi Sugita, Tokyo (JP)

(72) Inventors: Daikai Zaitsu, Kanagawa (JP); Junichi Sugita, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 8 days.

(21) Appl. No.: 16/293,810

(22) Filed: Mar. 6, 2019

(65) Prior Publication Data

US 2019/0283990 A1 Sep. 19, 2019

(30) Foreign Application Priority Data

Mar. 16, 2018 (JP) ..... JP2018-049708

(51) Int. Cl.
*B65H 1/26* (2006.01)
*B65H 1/04* (2006.01)
(Continued)

(52) U.S. Cl.
CPC ..... *B65H 1/266* (2013.01); *B41J 13/0018* (2013.01); *B41J 13/103* (2013.01);
(Continued)

(58) Field of Classification Search
CPC ..... B65H 1/04; B65H 1/266; B65H 2511/11; B65H 2511/12; B65H 2402/64;
(Continued)

(56) References Cited

U.S. PATENT DOCUMENTS 8,109,504 B2 * 2/2012 Matsuoka ..... G03G 15/6502 271/171
9,108,812 B2 * 8/2015 Sato ..... G03G 15/6502
(Continued)

FOREIGN PATENT DOCUMENTS

CN 1841221 A 10/2006
CN 108622686 A 10/2018
(Continued)

OTHER PUBLICATIONS

Extended European Search Report dated Sep. 9, 2019.
Office Action for Chinese Patent Application No. 201910183648.X dated Apr. 27, 2021.

*Primary Examiner* — Luis A Gonzalez
(74) *Attorney, Agent, or Firm* — Harness, Dickey & Pierce, P.L.C.

(57) ABSTRACT

A sheet loading device includes a device body to load a sheet, a guide disposed extending in a sheet conveying direction in the device body, a restricting body to move along the guide of the device body and to restrict a position of an end portion of the sheet, and a securing body to attach to the restricting body and the guide and detach from the restricting body and the guide, and having an engaging body. The engaging body of the securing body engages with the guide at an arbitrary position on the guide in the sheet conveying direction. The restricting body is being secured to the device body according to engagement of the engaging body of the securing body with the guide of the device body.

18 Claims, 11 Drawing Sheets

(51) Int. Cl.
*B41J 13/10* (2006.01)
*B41J 13/00* (2006.01)
*G03G 15/00* (2006.01)

(52) U.S. Cl.
CPC .. *G03G 15/6502* (2013.01); *B65H 2405/1122* (2013.01); *B65H 2405/1144* (2013.01)

(58) Field of Classification Search
CPC .... B65H 2402/5155; B65H 2402/5164; B65H 2402/5151; B65H 2405/121; B65H 2405/1122; B65H 2405/1144
See application file for complete search history.

(56) References Cited

U.S. PATENT DOCUMENTS

| | | | | |
|---|---|---|---|---|
| 9,162,833 | B2 * | 10/2015 | Udagawa | B65H 1/266 |
| 9,725,263 | B2 | 8/2017 | Takai et al. | |
| 2006/0222434 | A1 | 10/2006 | Kitamura et al. | |
| 2008/0298873 | A1 | 12/2008 | Yamagishi | |
| 2017/0121138 | A1 | 5/2017 | Koga | |
| 2018/0265315 | A1 | 9/2018 | Doshida et al. | |

FOREIGN PATENT DOCUMENTS

| | | | | |
|---|---|---|---|---|
| JP | 02095628 | A | * | 4/1990 |
| JP | 10329951 | A | * | 12/1998 |
| JP | 2001-310824 | A | | 11/2001 |
| JP | 3432647 | B2 | | 8/2003 |
| JP | 2004-115212 | | | 4/2004 |
| JP | 2015-040093 | | | 3/2015 |
| JP | 2015-229536 | | | 12/2015 |

* cited by examiner

SHEET LOADING DEVICE AND IMAGE FORMING APPARATUS INCORPORATING THE SHEET LOADING DEVICE

CROSS-REFERENCE TO RELATED APPLICATION

This patent application is based on and claims priority pursuant to 35 U.S.C. § 119(a) to Japanese Patent Application No. 2018-049708, filed on Mar. 16, 2018, in the Japan Patent Office, the entire disclosure of which is hereby incorporated by reference herein.

BACKGROUND

Technical Field

This disclosure relates to a sheet loading device and an image forming apparatus incorporating the sheet loading device.

Background Art

In an electrophotographic image forming apparatus, a sheet feeding tray (cassette) into which paper sheets (sheets) are loaded includes a restricting member (fence or guide) that restricts an end position of the paper sheets. The restricting members include an end fence and a side fence. The end fence restricts a back end in a sheet conveyance direction. The side fence restricts an end in a sheet width direction.

Generally, an image forming apparatus has a function of recognizing at least one position of the end fence and the position of the side fence, and automatically setting a paper size. Therefore, in the case where the end fence is set in an incorrect position, loading paper sheets in an inappropriate position causes failure in sheet feeding, in which no paper sheet is fed from the sheet feeding tray. Furthermore, a size recognized as being different from the size of loaded paper sheets causes failure in conveyance, such as occurrence of a paper jam in a sheet conveyance passage.

There is a known configuration in which the end fence and the side fence are screwed and secured to the sheet feeding tray for the purpose of preventing an incorrect setting of the end fence. In addition, a known sheet feeding cassette includes a configuration in which a position securing member is attached to secure the position of a sheet restricting member to prevent a restricting function of the sheet restricting member from being impaired by erroneous operation by a user.

SUMMARY

At least one aspect of this disclosure provides a sheet loading device including a device body, a guide, a restricting body, and a securing body. The device body loads a sheet. The guide is disposed extending in a sheet conveying direction in the device body. The restricting body moves along the guide of the device body and to restrict a position of an end portion of the sheet. The securing body attaches to the restricting body and the guide and detaches from the restricting body and the guide. The securing body has having an engaging body. The engaging body of the securing body engages with the guide at an arbitrary position on the guide in the sheet conveying direction. The restricting body is being secured to the device body according to engagement of the engaging body of the securing body with the guide of the device body.

Further, at least one aspect of this disclosure provides an image forming apparatus including the above-described sheet loading device.

Further, at least one aspect of this disclosure provides a sheet loading device including a device body, a guide, an engagement target body, a restricting body, and a securing body. The device body loads a sheet. The guide is disposed extending in a sheet conveying direction in the device body. The engagement target body is disposed separately from the guide in the device body and extends in parallel with the guide in the sheet conveying direction. The restricting body moves along the guide of the device body and to restrict a position of an end portion of the sheet. The securing body attaches to the restricting body and the guide and detach from the restricting body. The securing body has an engaging body. The engaging body of the securing body engages with the engagement target body at an arbitrary position on the engagement target body in the sheet conveying direction. The restricting body is secured to the device body according to engagement of the engaging body of the securing body with the engagement target body of the device body.

Further, at least one aspect of this disclosure provides an image forming apparatus including the above-described sheet loading device.

Further, at least one aspect of this disclosure provides a sheet loading device including a device body, a guide, a restricting body, a securing body, a first engagement target body, a second engagement target body. The device body loads a sheet. The guide is disposed extending in a sheet conveying direction in the device body. The restricting body moves along the guide of the device body and to restrict a position of an end portion of the sheet. The securing body attaches to the sheet loading device and detach from the sheet loading device. The securing body has a first engaging body and a second engaging body. The first engagement target body engages with the first engaging body of the securing body. The second engagement target body engages with the second engaging body of the securing body. The securing body is held by the first engagement target body and the second engagement target body. The device body includes a third engagement target body to engage with the first engaging body of the securing body. The restricting body includes a fourth engagement target body to engage with the second engaging body of the securing body. The first engaging body of the securing body engages with the third engagement target body and the second engaging body of the securing body engaging with the fourth engagement target body. The restricting body is secured to the device body at an arbitrary position on the guide according to engagement of the securing body and the device body.

Further, at least one aspect of this disclosure provides an image forming apparatus including the above-described sheet loading device.

BRIEF DESCRIPTION OF THE DRAWINGS

The aforementioned and other aspects, features, and advantages of this disclosure would be better understood by reference to the following detailed description when considered in connection with the accompanying drawings, wherein.

Figure 1:
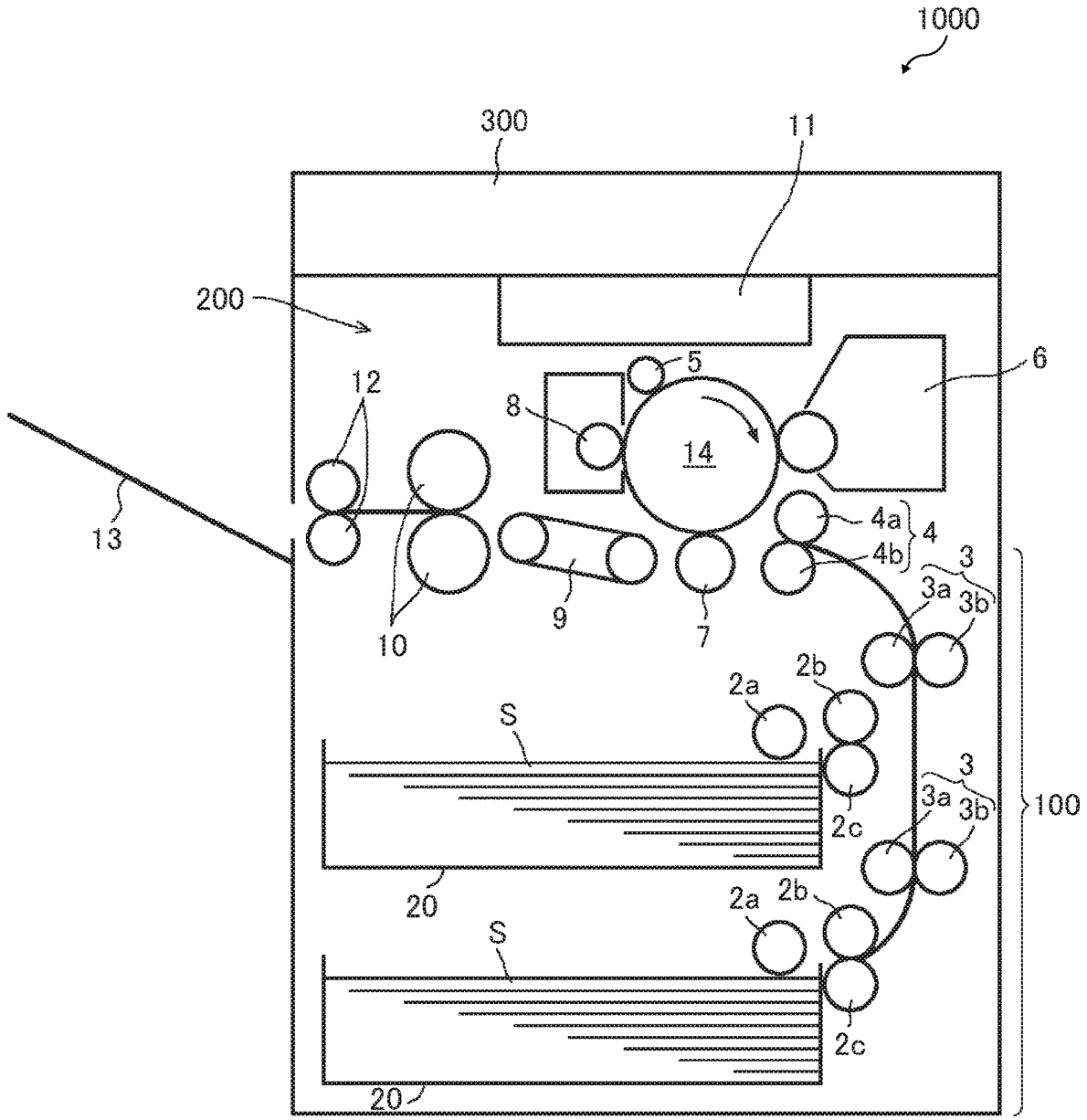
FIG. 1 is a schematic diagram illustrating an image forming apparatus according to one embodiment of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet loading device, and an image forming apparatus incorporating the sheet loading device.

It is to be noted that elements (for example, mechanical parts and components) having the same functions and shapes are denoted by the same reference numerals throughout the specification and redundant descriptions are omitted.

Now, a description is given of the sheet conveying device according to this disclosure with reference to the following figures.

Embodiment

FIG. 1 is a schematic diagram illustrating an image forming apparatus 1000 according to one embodiment of this disclosure.

The image forming apparatus 1000 may be a copier, a facsimile machine, a printer, a multifunction peripheral or a multifunction printer (NFP) having at least one of copying, printing, scanning, facsimile, and plotter functions, or the like. According to the present example, the image forming apparatus 1000 is an inkjet image forming apparatus that forms toner images on recording media by discharging ink to the recording media.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 1000 includes a sheet conveyer 100, an image forming device 200, and an image reader 300. The image forming device 200 is provided substantially above the sheet conveyer 100. The image reader 300 is further provided above the image forming device 200. The sheet conveyer 100 includes, as a sheet feeder, a sheet feeding tray 20 into which paper sheets (sheets) S are loaded, a pickup roller 2*a* for sending the paper sheets S on the sheet feeding tray 20, and a pair of rollers (a feed roller 2*b* and a reverse roller 2*c*) for separating the paper sheets S. Furthermore, the sheet conveyer 100 includes conveyance rollers 3*a* and 3*b*, and registration rollers 4*a* and 4*b*. In this manner, the sheet conveyer 100 conveys the paper sheets S sent from the sheet feeding tray 20 toward the image forming device 200.

It is to be noted that FIG. 1 is a schematic diagram. In addition to the illustrated ones, the sheet conveyer 100 also includes a plurality of pairs of rollers for conveying the paper sheets S. The plurality of pairs of rollers is provided at intervals appropriate for conveying the paper sheets S.

The image forming device 200 includes a photoconductor (transfer roller) 14, a charger 5 disposed on the periphery of the photoconductor (transfer roller) 14, a developing means 6, a transferrer 7, a cleaner 8, a conveyance belt 9 for conveying a paper sheet S to which an image has been transferred. Furthermore, the image forming device 200 also includes a fixing device 10, and a writer 11. The fixing device 10 fixes the paper sheet S on which the image has been formed. The writer 11 partially exposes the photoconductor (transfer roller) 14 uniformly charged, to form a latent image.

Next, a process of forming an image on the paper sheet S will be described. When a sheet feeding signal is turned on, the pickup roller 2*a* descends and rotates to send the paper sheets S on the sheet feeding tray 20. The sent paper sheets S are separated one by one at a nip between the feed roller 2*b* and the reverse roller 2*c* to reach the conveyance rollers 3*a* and 3*b*. Then, each of the separated paper sheets S is further conveyed to abut against a nip between the registration rollers 4*a* and 4*b* to be subjected to skew correction. Then, the paper sheet S is delivered at an appropriate timing to meet a toner image on the photoconductor (transfer roller) 14 having a drum shape.

Next, the image forming device 200 forms an image on the paper sheet S supplied from the sheet conveyer 100 and causes the image on the paper sheet S to be fixed by the fixing device 10. The paper sheet S on which the image has been fixed is ejected into a sheet ejection tray 13 via sheet ejection rollers 12.

Figure 2:
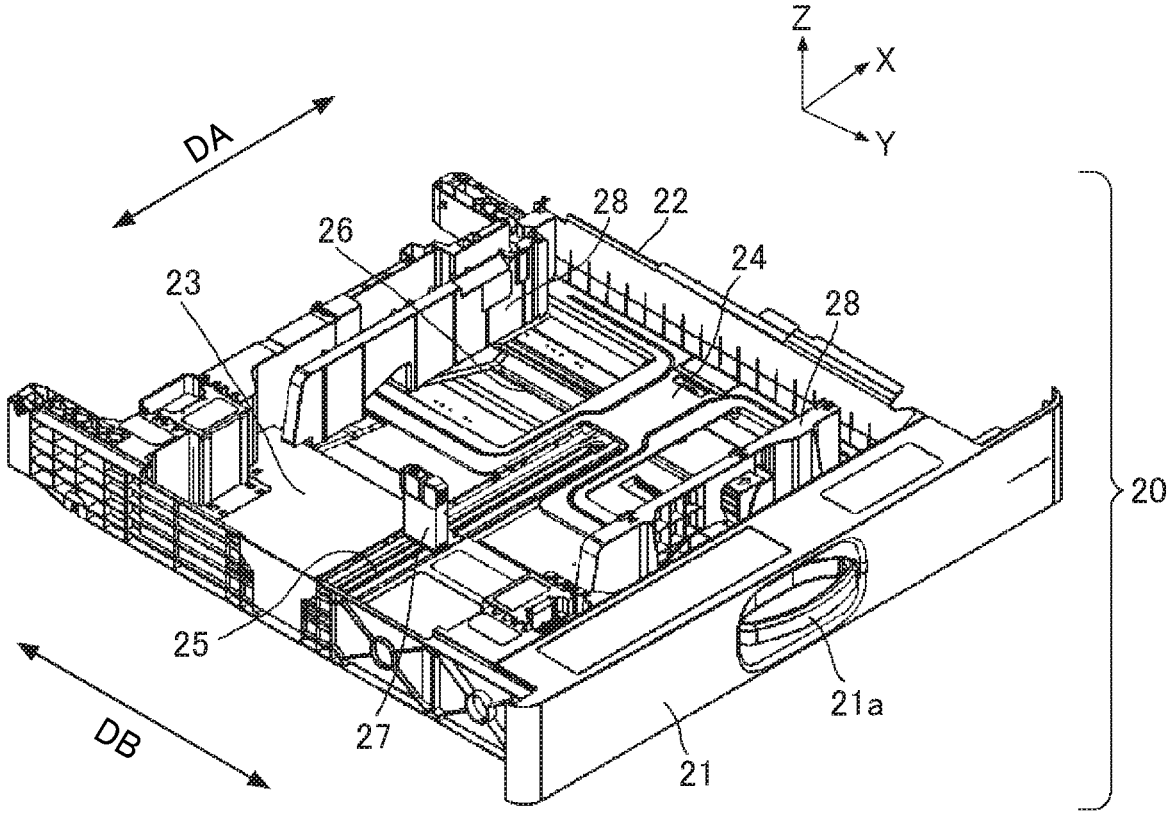
FIG. 2 is a perspective view of a sheet feeding tray according to the one embodiment of this disclosure.

FIG. 2 is a perspective view of a sheet feeding tray according to the one embodiment of this disclosure. As illustrated in FIG. 2, the sheet feeding tray 20 that functions as a sheet loading device is formed in a substantially rectangular parallelepiped box shape. The sheet feeding tray 20 includes a device body 22 into which sheets are loaded. The device body 22 includes a bottom plate 24 for raising sheets S, a first guide rail 25, a second guide rail 26, an end fence 27, and a side fence 28, which are provided on a base portion 23 of the device body 22. In addition, the sheet feeding tray 20 includes an exterior cover 21 provided at one of four sides of the sheet feeding tray 20. The exterior cover 21 includes a handle 21*a* provided at a central portion of the exterior cover 21. A user can grip the handle 21*a* to insert or remove the sheet feeding tray 20 in ±Y directions with respect to the image forming apparatus 1000.

Specifically, the sheets S are loaded inside the sheet feeding tray 20 that is pulled in the +Y direction. Then, the sheet feeding tray 20 is pushed in the −Y direction to be mounted in an apparatus body of the image forming apparatus 1000.

The sheet feeding tray 20 includes the end fence 27 (a single unit) and a pair of the side fences 28. The end fence 27 and the pair of side fences 28 are provided such that upper space (space for loading the sheets 5), in which the bottom plate 24 is provided, is surrounded by the end fence 27 and the pair of side fences 28 on three sides other than a forward side in a sheet conveying direction DA (+X direction).

The first guide rail 25 that functions as a guide is provided on the base portion 23, extending in the sheet conveying direction DA (±X directions). The end fence 27 can be manually moved in the sheet conveying direction DA, along the first guide rail 25, to be positioned according to the size of the sheets S in the sheet conveying direction DA. That is, the end fence 27 functions as a first restricting member that functions as a restricting body to restrict an end position of the sheets S in the sheet conveying direction DA.

In addition, the second guide rail 26, as a guide, is provided on the base portion 23, extending in a sheet width direction DB (±Y directions). The pair of side fences 28 are installed at respective ends in the sheet width direction DB so as to hold the sheets S between the pair of side fences 28.

The pair of side fences 28 can be manually moved in the sheet width direction DB, along the second guide rail 26, to be positioned according to the size of the sheets S in the sheet width direction DB. That is, the side fence 28 functions as a second restricting member that functions as another restricting body to restrict a position of the sheets S in the sheet width direction DB in a position different from the end fence 27.

In the present embodiment, the pair of side fences 28 operate in conjunction with each other to increase or decrease an interval in the sheet width direction DB. That is, when one of the side fences 28 is manually moved in the +Y direction, the other side fence 28 moves in the −Y direction in conjunction with the movement of the one of the side fences 28. In addition, when one of the side fences 28 is manually moved in the −Y direction, the other side fence 28 moves in the +Y direction in conjunction with the movement of the one of the side fences 28.

A rack and pinion mechanism can be used as a movement mechanism for causing the pair of side fences 28 to move in conjunction with each other, as described above. This mechanism includes a first rack gear, a second rack gear, and a pinion gear. The first rack gear is integrally formed, extending in the sheet width direction DB orthogonally to one of the side fences 28. The second rack gear is integrally formed, extending in the sheet width direction DB orthogonally to the other side fence 28. The pinion gear is disposed between the first rack gear and the second rack gear to be engaged with both rack gears.

It is to be noted that FIG. 2 is based on the assumption that the sheets S are fed in the X direction, and the sheet feeding tray 20 can be inserted or removed in the ±Y directions. Meanwhile, this disclosure is not limited to these directions.

Figure 3A:
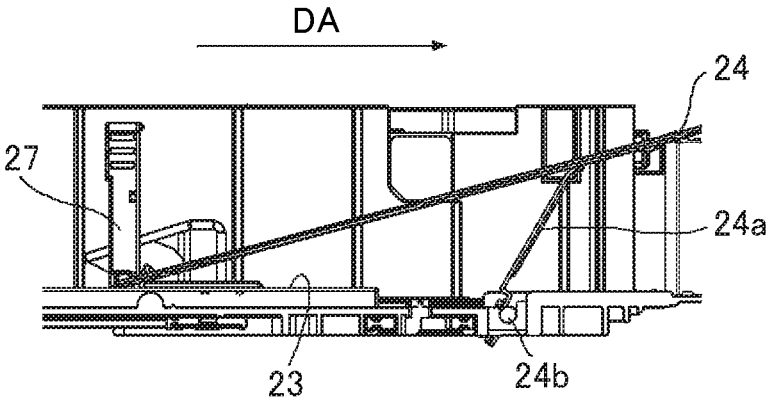
FIG. 3A is a cross-sectional view of a lifting mechanism of a bottom plate.
Figure 3B:
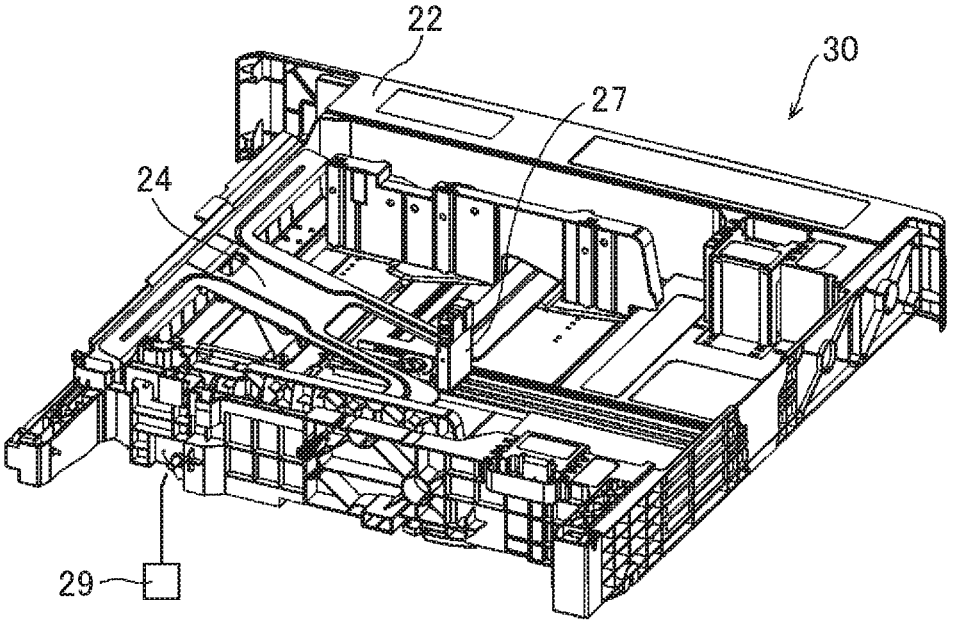
FIG. 3B is a perspective view of the lifting mechanism of the bottom plate.

FIG. 3A is a cross-sectional view of a lifting mechanism of the bottom plate. FIG. 3B is a perspective view of the lifting mechanism of the bottom plate. As illustrated in FIGS. 3A and 3B, a lifting lever 24*a* is provided, as a mechanism for moving the bottom plate 24 up and down, between the bottom plate 24 and the base portion 23. The lifting lever 24*a* is driven by a motor 29 to rotate. Specifically, the bottom plate 24 is rotationally movable around a back end in the sheet conveying direction DA, and the lifting lever 24*a* is rotationally movable around a lifting lever shaft 24*b*. The lifting lever 24*a* is driven by the motor 29 to rotate to lift the bottom plate 24 up and down. As a result, a forward end of the bottom plate 24 in the sheet conveying direction DA can be moved up and down. Furthermore, the motor 29 is appropriately controlled by a controller of the image forming apparatus 1000. Therefore, the sheet feeding tray 20 can smoothly feed the loaded sheets S regardless of the number of the loaded sheets S.

Alternatively, instead of the above, there may be provided a compression spring that is urged or limited with respect to urging force in conjunction with insertion or removal of the sheet feeding tray 20.

Figure 4A:
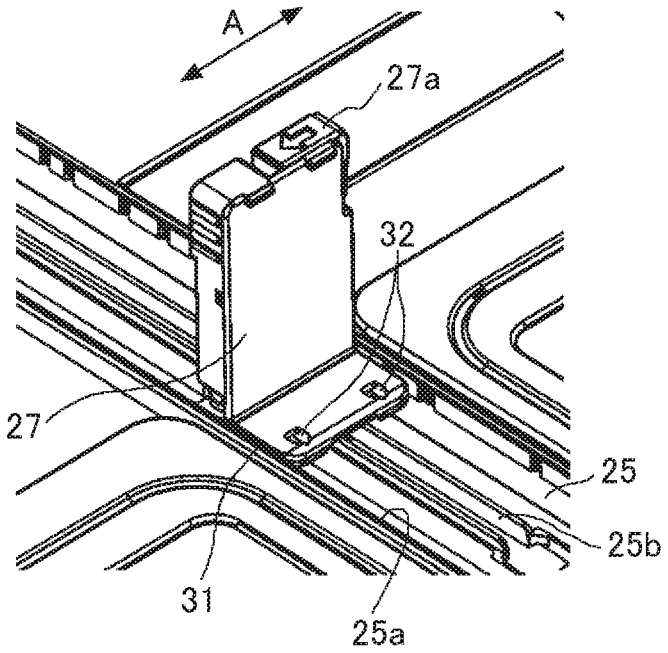
FIG. 4A is a perspective view of a first guide rail and an end fence according to the one embodiment of this disclosure, viewed from obliquely above.
Figure 4B:
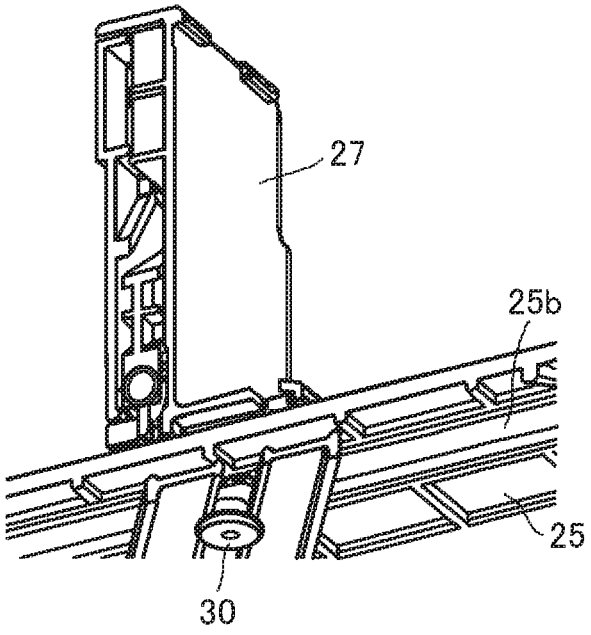
FIG. 4B is a perspective view of the first guide rail and the end fence viewed from obliquely below.

FIG. 4A is a perspective view of the first guide rail and the end fence according to the one embodiment of this disclosure, viewed from obliquely above. FIG. 4B is a perspective view of the first guide rail and the end fence viewed from obliquely below. As illustrated in FIG. 4A, the first guide rail 25 includes walls formed in a manner to hold a lower portion of the end fence 27 disposed between the walls. One of the walls includes a rack 25*a* subjected to gear cutting. In addition, the first guide rail 25 includes a guide groove 25*b* for supporting and guiding a bottom portion of the end fence 27. As illustrated in FIG. 4B, the bottom portion of the end fence 27 is supported by a support pin 30, with the first guide rail 25 interposed between the bottom portion of the end fence 27 and the support pin 30.

Furthermore, as illustrated in FIG. 4A, the end fence 27 includes a latch 31 to be engaged with the rack 25*a* of the first guide rail 25, and an operation member 27*a* for operating the latch 31. The latch 31 is urged by a spring, and constantly engaged with the rack 25a. The latch 31 is separated from the rack 25*a* in conjunction with operation of the operation member 27*a*. That is, operating the operation member 27*a* in a predetermined direction (direction of an arrow A in the drawing) enables the end fence 27 to be secured to or released from the first guide rail 25.

When the operation member 27*a* is operated to put the end fence 27 in a released state, the end fence 27 can freely move on the first guide rail 25. Meanwhile, when the operation member 27*a* is released, the latch 31 automatically engages with the rack 25*a* to secure the end fence 27 to the first guide rail 25. In this manner, the end fence 27 according to the present embodiment can be secured to the first guide rail 25 in an arbitrary position on the first guide rail 25.

Furthermore, the end fence 27 has engagement holes 32 to be engaged with a securing member to be described below. Details of the characteristics of the securing member will be described below.

Figure 5A:
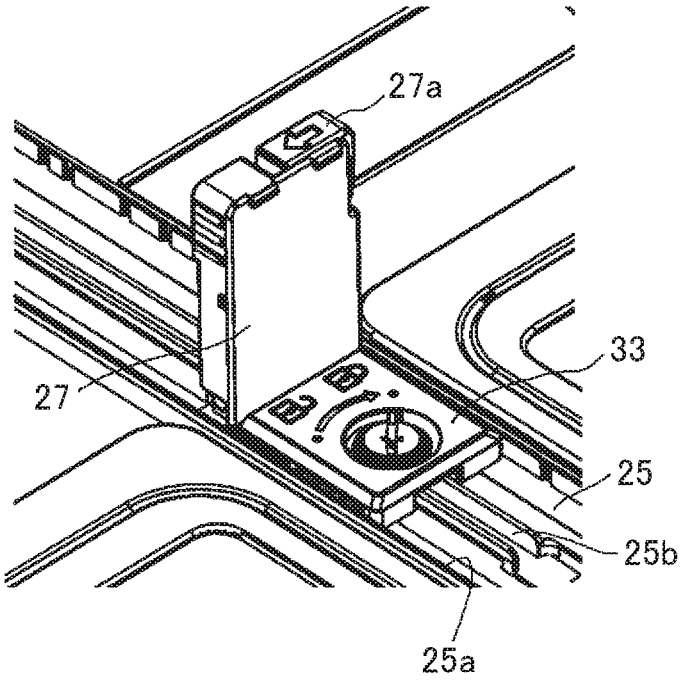
FIG. 5A is a perspective view of the end fence and a securing member according to the one embodiment of this disclosure, viewed from obliquely above.
Figure 5B:
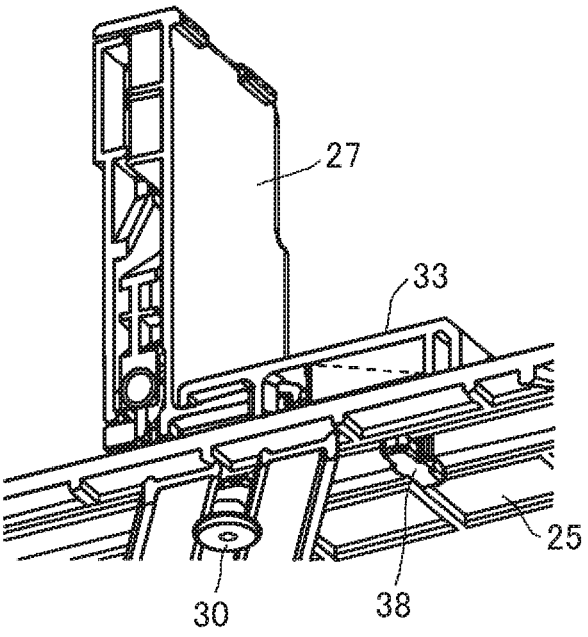
FIG. 5B is a perspective view of the end fence and the securing member viewed from obliquely below.

FIG. 5A is a perspective view of the end fence and the securing member according to the one embodiment of this disclosure, viewed from obliquely above. FIG. 5B is a perspective view of the end fence and the securing member viewed from obliquely below As illustrated in FIGS. 5A and 5B, this disclosure is characterized by attachment of a securing member 33 to the end fence 27. As described above, while the end fence 27 can be secured to the first guide rail 25 in an arbitrary position on the first guide rail 25, a simple operation allows the end fence 27 to he movable. Therefore, there has been a possibility that a user erroneously moves the end fence 27 to cause an operational error such as loading paper sheets in different sizes. The securing member 33 functions as a securing body that is an error proofing (foolproof) jig used to prevent such a careless mistake.

Figure 6A:
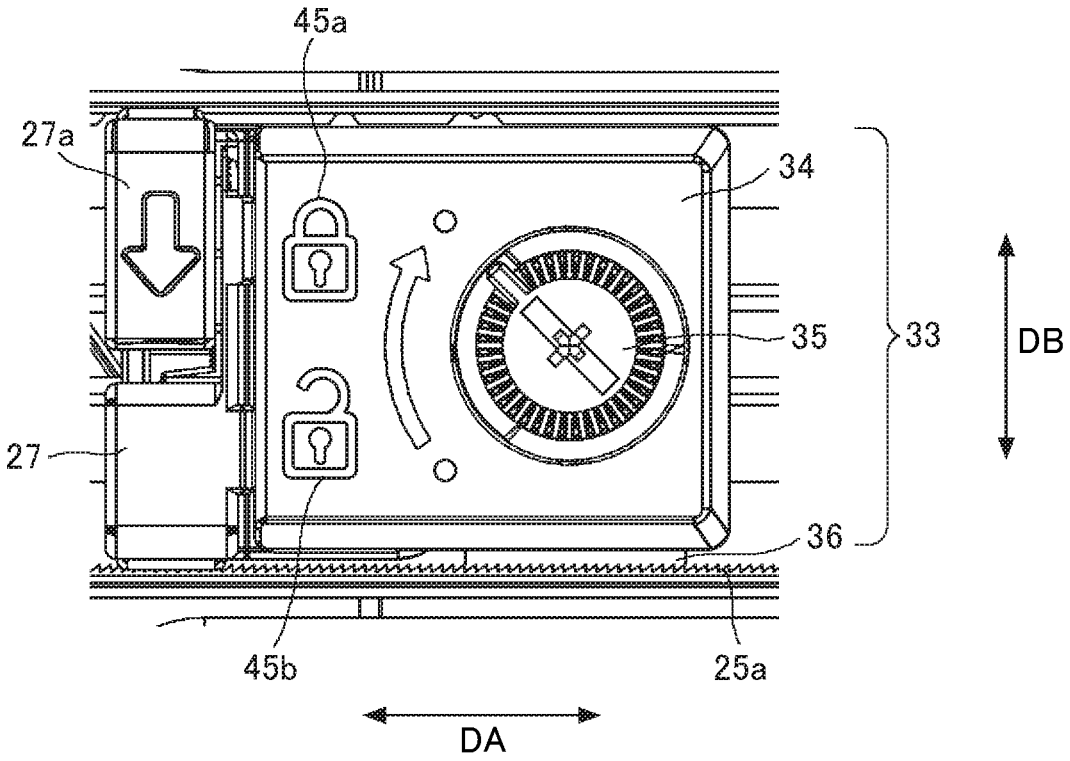
FIG. 6A is a plan view of the securing member according to the one embodiment of this disclosure.
Figure 6B:
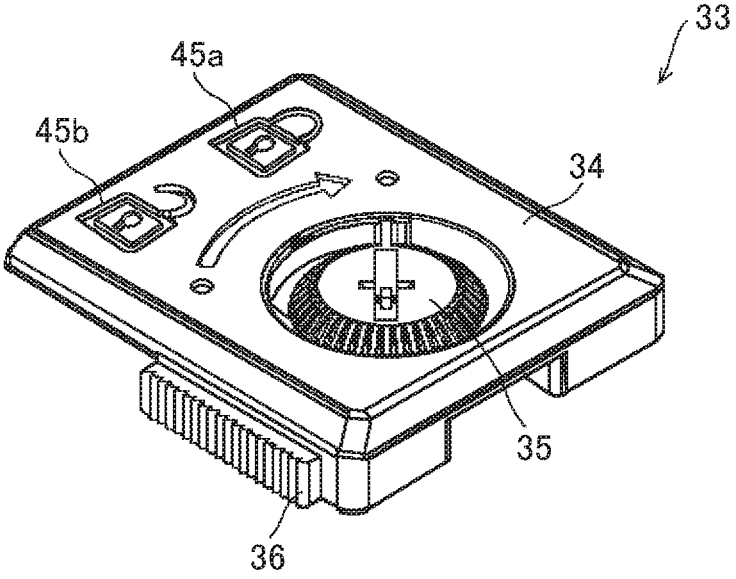
FIG. 6B is a perspective view of the securing member.
Figure 7A:
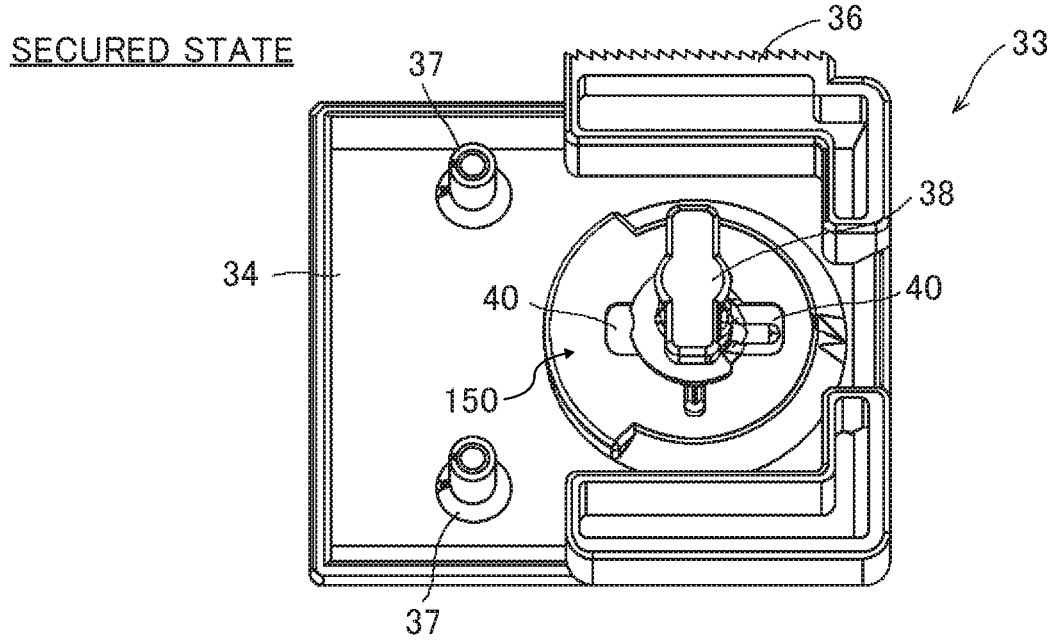
FIG. 7A is a plan view of a back side of the securing member according to the one embodiment of this disclosure, in a secured state.
Figure 7B:
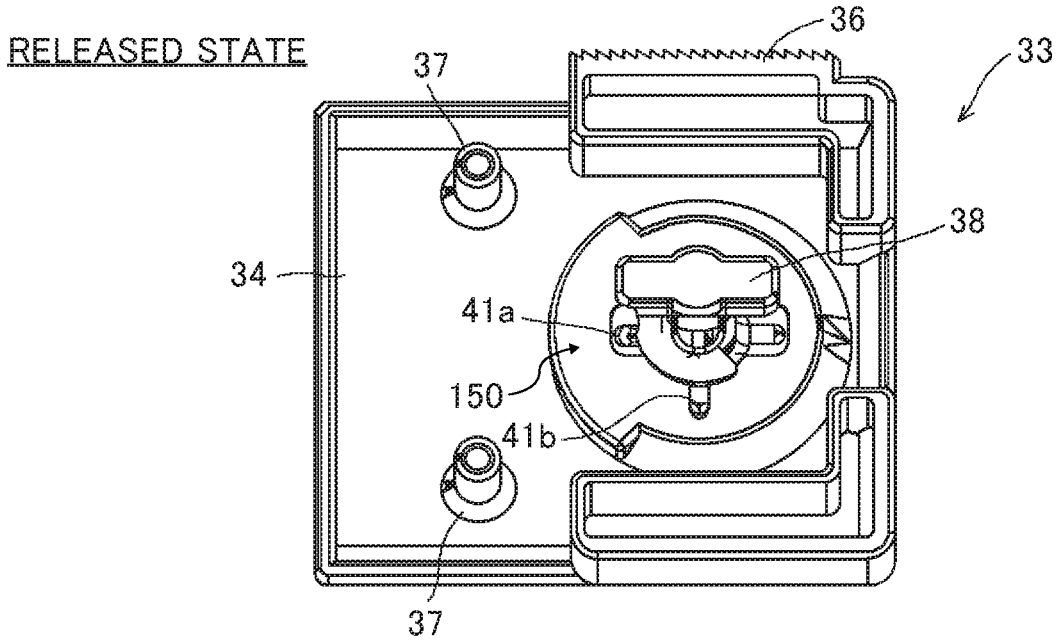
FIG. 7B is a plan view of the back side of the securing member in a released state.

FIG. 6A is a plan view of the securing member according to the one embodiment of this disclosure. FIG. 6B is a perspective view of the securing member. FIG. 7A is a plan view of a back side of the securing member according to the one embodiment of this disclosure, in a secured state. FIG. 7B is a plan view of the back side of the securing member in the released state.

As illustrated in FIGS. 6A and 6B, the securing member 33 includes a securing plate 34, an operation member 35, and a latch 36. The securing plate 34 serves as a base. The operation member 35 is rotatably provided on the securing plate 34. The latch 36 engages with the rack 25*a* of the first guide rail 25. In addition, as illustrated in FIGS. 7A and 7B, the securing member 33 includes, on the back side, two engagement pins 37 and an engagement tool 38. The engagement tool 38 that functions as an engaging body is rotated by the operation member 35 that functions as a switching body. It is to be noted that each of the engagement pins 37 of the securing member 33 is an example of an engaging body, and the engagement tool 38 of the securing member 33 is an example of an engaging body.

The two engagement pins 37 have a shape corresponding to the shape of the engagement holes 32 of the end fence 27. The engagement tool 38 of the securing member 33 is formed as a T-shaped protrusion, and rotated by the operation member 35 to engage with the guide groove 25*b*. The guide groove 25*b* is provided in the first guide rail 25, and continuously extends in a direction parallel to a direction in which the first guide rail 25 extends, that is, in the sheet conveying direction DA (see FIGS. 4A and 4B).

The engagement hole 32 (functioning as an engagement opening) of the end fence 27 is an example of an engagement target body to be engaged corresponding to a corresponding one of the engagement pins 37 (that functions as an engaging body) of the securing member 33. The guide groove 25*b* is an example of another engagement target body to be engaged corresponding to the engagement tool 38 (that functions as an engaging body) of the securing member 33.

The securing member 33 can be attached to and detached from the end fence 27 and the first guide rail 25. An attachment procedure is as follows. First, while the engagement pins 37 of the securing member 33 are engaged with the engagement holes 32 of the end fence 27, the securing member 33 is attached to the first guide rail 25. At this time, the latch 36 of the securing member 33 engages with the rack 25*a* of the first guide rail 25 to fix the position of the securing member 33 with respect to the first guide rail 25.

Then, the operation member 35 is operated (rotated) to engage the engagement tool 38 of the securing member 33 with the guide groove 25*b* of the first guide rail 25. Thus, the securing member 33 is firmly secured in position (see FIG. 5B). Here, the term "firmly" means that the end fence 27 cannot be moved even by operating the operation member 27a. It is to be noted that it is possible to detach the securing member 33 by following the above-described procedure in reverse order.

In a screw-securing configuration of a comparative sheet feeding tray that functions as a sheet loading device, the bottom of the end fence is screwed to a screw hole provided in the sheet feeding tray in advance. Accordingly, the end fence can be secured only in a fixed position. Therefore, the screw-securing configuration of the comparative sheet feeding tray cannot handle a paper sheet in a size other than regular sizes or a paper sheet with a minute error in paper size (paper cutting error).

By contrast, as described above, the sheet feeding tray 20 according to the present embodiment includes the securing member 33 that is attachable and detachable. The securing member 33 can secure the end fence 27 in an arbitrary position in a direction in which the guide groove 25*b* extends, i.e., in the sheet conveying direction DA. Therefore, even in the case of a paper sheet in a size other than regular sizes or a paper sheet with a minute error in paper size, the end fence 27 can be firmly secured according to the size of the paper sheet.

Variation.

The above-described embodiment is merely an example, and various modifications can be made. For example, the engagement tool 38 of the securing member 33 may be formed in a cam shape such that the operation member 35 is operated (rotated) to cause the engagement tool 38 to be secured, by frictional force, to the walls (one of the walls includes the rack 25*a*) of the first guide rail 25. In such a case, the guide groove 25*b* of the first guide rail 25 is not used to attach the securing member 33. It is to bee noted that the first guide rail 25 functions as an engagement target body to be engaged.

Furthermore, while the securing member 33 is attached to (engaged with) the guide groove 25*b* in the above-described embodiment, this disclosure is not limited thereto. Separately from the first guide rail 25, there may be provided, for example, a dedicated groove or rail that continuously extends in parallel with the first guide rail 25, and engages with the engagement tool 38 of the securing member 33. In the device body 22, the dedicated groove or rail may be provided directly below the rack 25*a* of the first guide rail 25 or on a side opposite to the securing member 33 with respect to the rack 25*a*.

Thus, the securing member 33 can secure the end fence 27 in an arbitrary position in a direction in which the dedicated groove or rail (member to be engaged) extends, i.e., in the sheet conveying direction DA.

Furthermore, the device body 22, the first guide rail 25, and the second guide rail 26 need not be integrally formed. It is possible to provide the device body 22, the first guide rail 25, and the second guide rail 26 as separate parts, and attach the first guide rail 25 and the second guide rail 26 to the device body 22.

The securing member 33 and the end fence 27 just need to include at least a set of an engagement pin and an engagement hole corresponding to each other. Accordingly, an engagement hole may be provided in the securing member 33, and an engagement pin may be provided on the end fence 27.

Next, advantageous configurations of this disclosure will be described.

Shape of Securing Member.

Figure 8A:
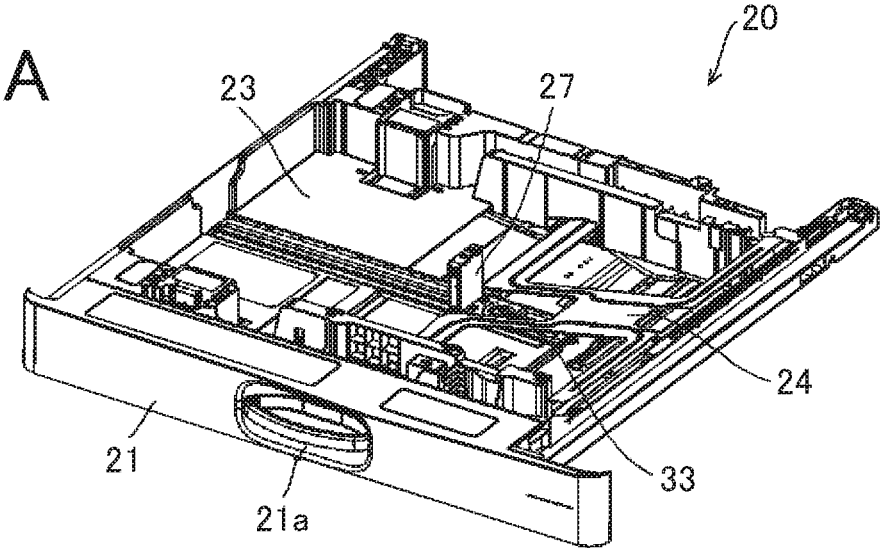
FIG. 8A is a perspective view of the sheet feeding tray, to which the securing member has been attached, with the bottom plate raised.
Figure 8B:
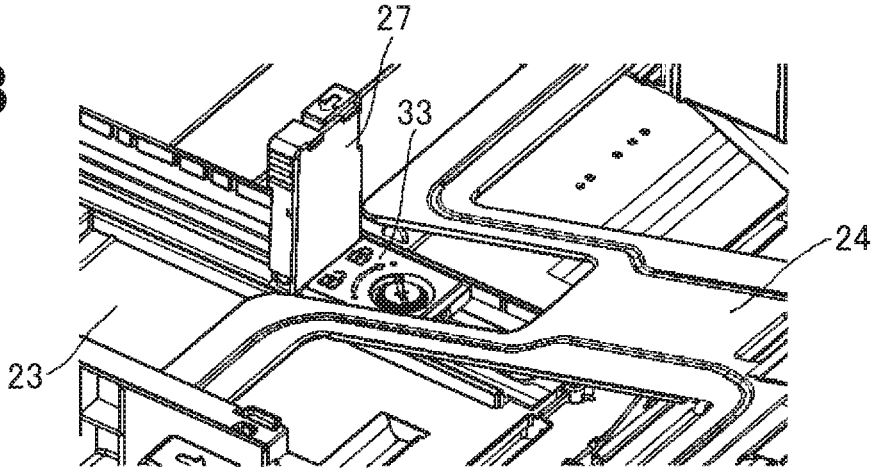
FIG. 8B is an enlarged view of an area in the vicinity of the securing member.

FIG. 8A is a perspective view of the sheet feeding tray, to which the securing member has been attached, with the bottom plate raised. FIG. 8B is an enlarged view of an area in the vicinity of the securing member. As illustrated in FIGS. SA and 8B, it is desirable that the securing member 33 be provided such that an upper surface of the securing member 33 in a vertical direction (i.e., Z direction) does not protrude from the bottom plate 24, or the upper surface protrudes from the bottom plate 24 by 2 mm or less. In other words, the upper surface of the securing member 33 protrudes in the vertical direction from the bottom plate in a range of 0 mm to 2 mm. Furthermore, it is preferable that the sheets S be out of contact with the securing member 33 even when the sheets S are loaded onto the bottom plate 24. Thus, it is possible to attach the securing member 33 without hindering the loading of the sheets S or damaging the sheets S.

Play of Securing Member.

As illustrated in FIGS. 4A, 4B, 7A, and 7B above, the end fence 27 has at least the engagement holes 32 that engage with the engagement pins 37 of the securing member 33. Here, it is desirable that the engagement holes 32 have clearance (play of approximately 2 mm) such that the engagement pins 37 can move in a direction of the first guide rail 25. Thus, even in the case where the securing member 33 is attached, sheets can be easily loaded. Furthermore, even in the case where unevenness in paper size in the sheet conveyance direction is caused by, for example, a paper cutting error, it is possible to make fine adjustments to the end fence 27 to absorb unevenness.

In the present embodiment, the engagement hole 32 of the end fence 27 is formed in a shape of a combination of a triangle and a quadrangle, viewed from above. A triangular portion can be used for visually recognizing a scale of sheet sizes (for example, A4 and B5) provided on the base portion 23. A quadrangular portion can be used as clearance (play) for allowing each of the engagement pin 37 of the securing member 33 to move. Thus, the above-described shape serves both functions, and is advantageous in this respect.

Click Mechanism.

In order to address this convenience and enhance a sense of security for a user, it is desirable for the operation member 35 of the securing member 33 to include a click mechanism 150 that generates a click feeling at the time of operation. In other words, it is desirable for the operation member 35 to generate a click feeling that can be recognized by a user when the state of the engagement tool 38 is changed from the released state to the secured state, and when the state of the engagement tool 38 is changed from the secured state to the released state.

One embodiment of the click mechanism 150 will be described below. As illustrated in FIGS. 7A and 7B above, a recess 40 is provided in (a back side of) the securing plate 34, and the operation member 35 includes a first protrusion 41*a* and a second protrusion 41*b*. The first protrusion 41*a* and the second protrusion 41*b* of the operation member 35 are out of phase by 90°. In the secured state, the second protrusion 41*b* is fitted in the recess 40 at a first position (FIG. 7A). In the released state, the first protrusion 41*a* is fitted in the recess 40 at a second position (FIG. 7B).

In order to change the position from the first position to the second position, the operation member 35 is rotated by 90°. When the operation member 35 is rotated, either the first protrusion 41*a* or the second protrusion 41*b* runs onto a portion other than the recess 40 to generate resistance. The resistance is eliminated only when one of the protrusions is fitted in the recess 40 at the first position or the second position. Therefore, it is possible to generate an appropriate click feeling at the first position or the second position.

Operation Mark.

As illustrated in FIGS. 6A and 6B above, it is desirable to make a mark 45*a* indicating the secured state and a mark 45*b* indicating the released state, on an outer surface of the securing plate 34. The marks 45*a* and 45*b* made on the securing plate 34 facilitate determination as to whether the engagement tool 38 is in the secured state (the first position) or the released state (the second position).

Enhancement in Operability.

Figure 9:
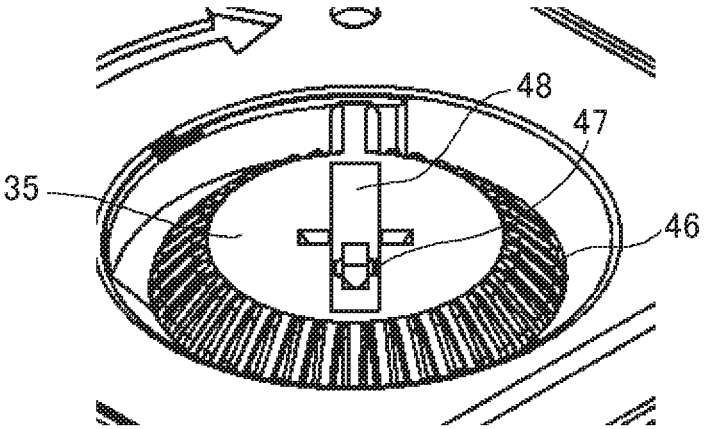
FIG. 9 is an enlarged perspective view of an operation member according to the one embodiment of this disclosure.

FIG. 9 is an enlarged perspective view of the operation member according to the one embodiment of this disclosure. As illustrated in FIG. 9, it is desirable for the operation member 35 to include a knurled portion 46 such that the end fence 27 can be secured or released by manual rotation of the operation member 35. Similarly, it is desirable to provide a crossed groove 47 so as to enable the end fence 27 to be secured or released with a Phillips-head screwdriver, or to provide a coin groove 48 so as to enable the end fence 27 to be secured or released with a coin. This enables a user to operate (rotate) the operation member 35 by various means, resulting in enhancement in operability.

Next, a method for storing (housing) the securing member 33 according to this disclosure will be described below.

In the conventional securing method using a screw, a securing screw is removed in the case where an end fence is not secured. In many cases, storage of the securing screw is left entirely to a user. Accordingly, there are cases where the user loses the securing screw by mistake. The securing member 33 according to this disclosure can also be detached from the sheet feeding tray 20. Thus, there is a possibility that a similar disadvantage may be caused. Therefore, described below is a configuration for preventing the securing member 33 according to this disclosure from being lost when not in use.

Figure 10A:
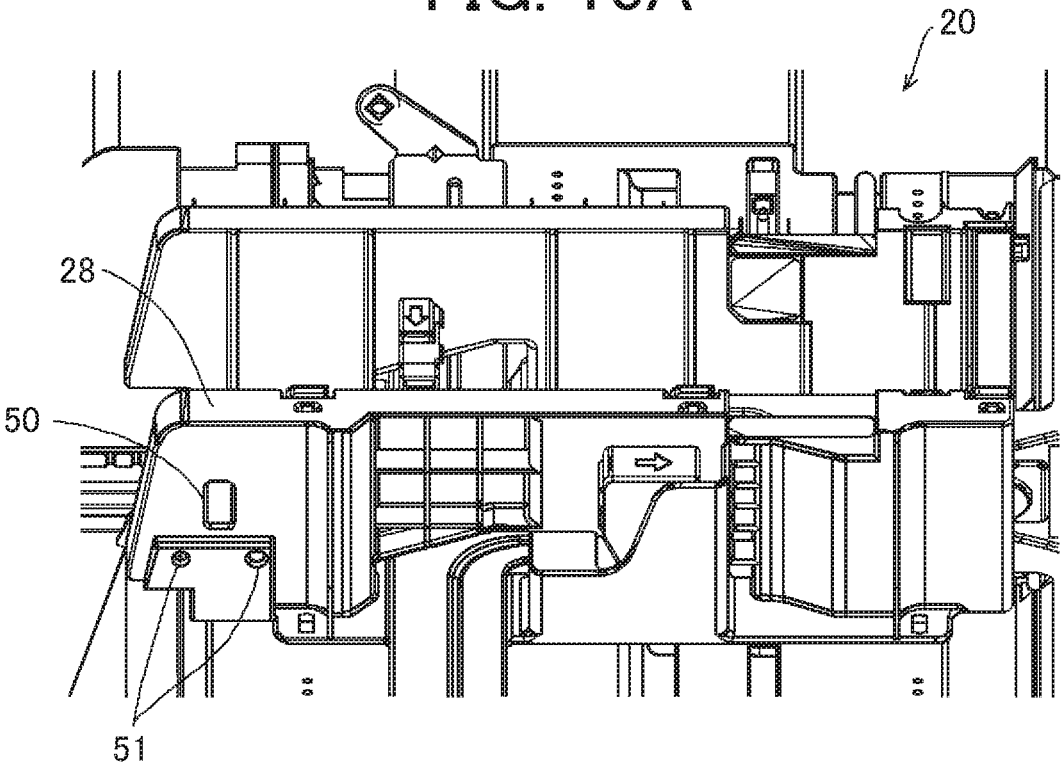
FIG. 10A is a perspective view of a side fence according to the one embodiment of this disclosure.
Figure 10B:
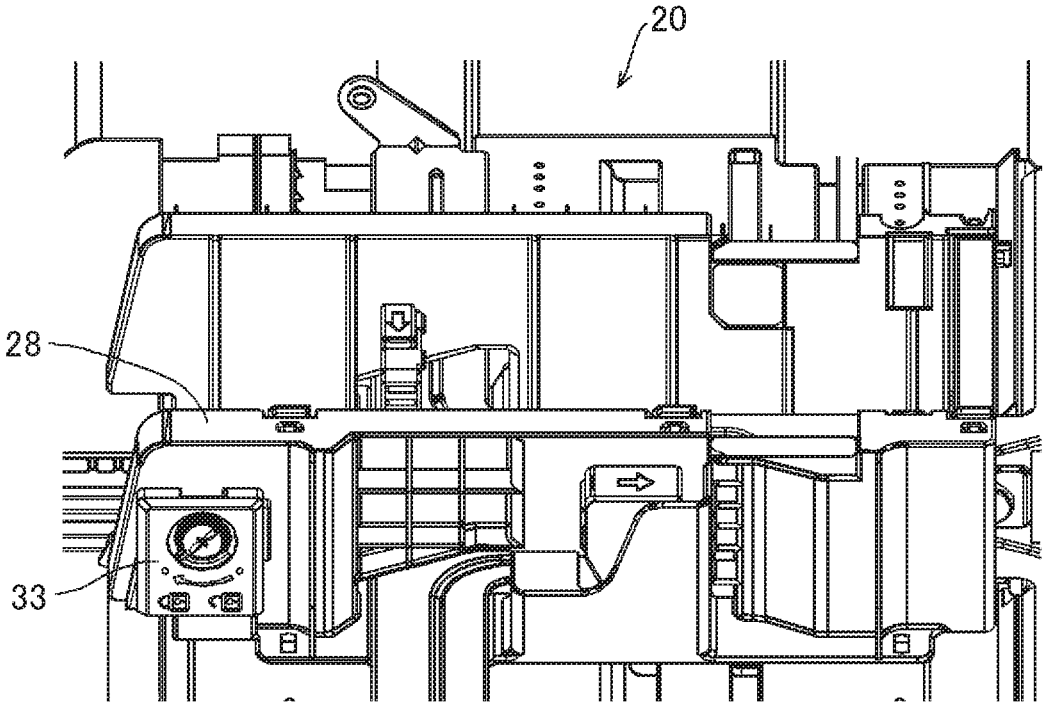
FIG. 10B is a perspective view illustrating the securing member in a held (housed) state.

FIG. 10A is a perspective view of the side fence according to the one embodiment of this disclosure. FIG. 10B is a perspective view illustrating the securing member in a held (housed) state. As illustrated in FIG. 10A, the side fence 28 includes a holding hole 50 that functions as an engaging body to hold the engagement tool 38 of the securing member 33, and engagement holes 51 that functions as an engaging body to engage with the engagement pins 37 of the securing member 33. Here, a positional relationship between the holding hole 50 and the engagement holes 51 is the same as a positional relationship between the guide groove 25*b* of the first guide rail 25 and the engagement holes 32 of the end fence 27. When the securing member 33 is attached to the side fence 28, a position of the securing member 33 in a height direction (i.e., the vertical direction in FIGS. 10A and 10B) is determined by the holding hole 50, and a position of the securing member 33 in a lateral direction (horizontal direction in FIGS. 10A and 10B) is determined by the engagement holes 51. Therefore, as illustrated in FIG. 10B, the securing member 33 can be held on the side fence 28 in an attachable and detachable manner.

The holding hole 50 of the side fence 28 is an example of an engagement target body to be engaged corresponding to the engagement tool 38 (that functions as an engaging body) of the securing member 33. The engagement hole 51 of the side fence 28 is an example of another engagement target body to be engaged corresponding to a corresponding one of the engagement pins 37 (that functions as an engaging body) of the securing member 33.

In this manner, the securing member 33 can be held on a front side in a direction in which the sheet feeding tray 20 is pulled. The held securing member 33 does not interfere with the device body 22 or the bottom plate 24 of the sheet feeding tray 20 to affect the operability of the side fence 28.

In the configuration of a comparative sheet loading device, the position securing member is applicable to each regular size. Therefore, the sheet restricting member can be secured only in a prescribed position. In order to secure the sheet restricting member in an arbitrary position, it is necessary to prepare the position securing member for each size, resulting in an increase in the number of parts. Moreover, it is also necessary to secure additional space for storing such position securing members.

By contrast, the holding hole 50 and the engagement hole 51 of the side fence 28 have shapes corresponding to the shapes of the engagement tool 38 and each of the engagement pins 37 of the securing member 33, respectively. In addition, positions of the engagement holes 51 relative to the holding hole 50 are the same as positions of the engagement holes 32 of the end fence 27 relative to the guide groove 25*b* of the first guide rail 25. Therefore, it is not necessary to separately provide dedicated parts or shapes so as to hold the securing member 33 on the side fence 28. Furthermore, the securing member 33 can be easily attached to or detached from either the side fence 28 or the first guide rail 25 in each position where the securing member 33 is held.

Figure 11A:
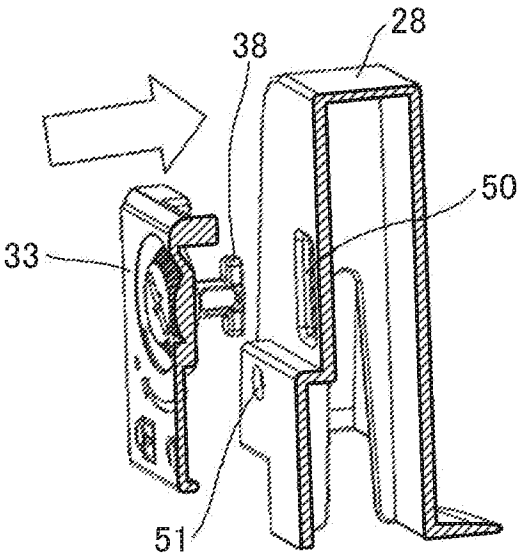
FIGS. 11A to 11C are perspective views illustrating a procedure for attaching the securing member to the side fence.
Figure 11B:
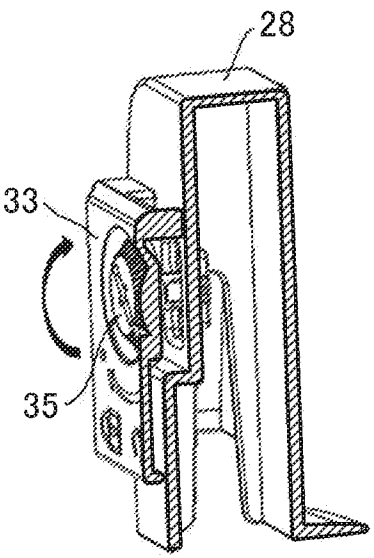
Figure 11C:
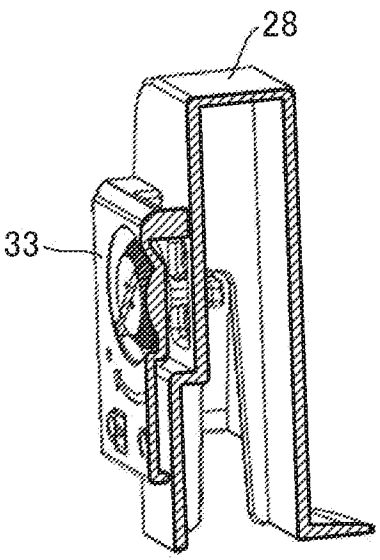

FIGS. 11A to 11C are perspective views illustrating a procedure for attaching the securing member to the side fence. As illustrated in FIG. 11A, in order to attach the securing member 33 to the side fence 28, the engagement tool 38 of the securing member 33 is first inserted into the holding hole 50 of the side fence 28. In addition, each of the engagement pins 37 of the securing member 33 is inserted into the engagement hole 51 of the side fence 28. Next, as illustrated in FIG. 1113, the operation member 35 is rotated by 90° to cause the engagement tool 38 of the securing member 33 to engage with the holding hole 50 of the side fence 28. Accordingly, as illustrated in FIG. 11C, the securing member 33 can be held on the side fence 28. It is also possible to detach the securing member 33 from the side fence 28 (sheet feeding tray 20) by following the above-described procedure in reverse order. Since the securing member 33 can be held on the side fence 28, it is easy to visually recognize the securing member 33 in the sheet feeding tray 20.

Figure 12A:
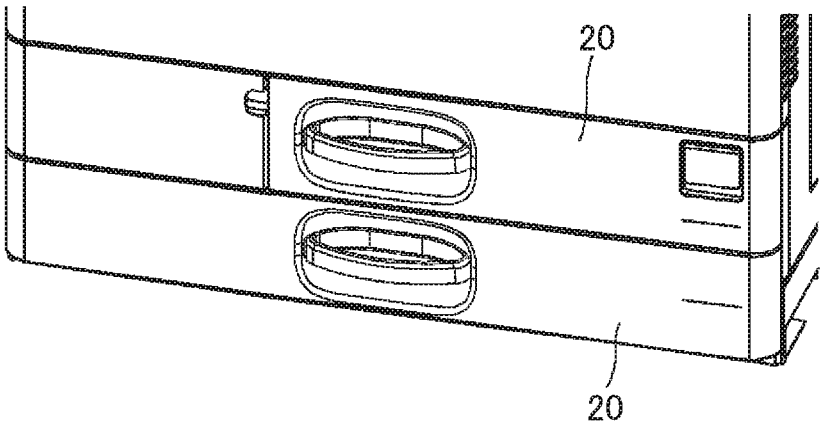
FIGS. 12A and 12B are perspective views illustrating a position in which the securing member is held in the image forming apparatus.
Figure 12B:
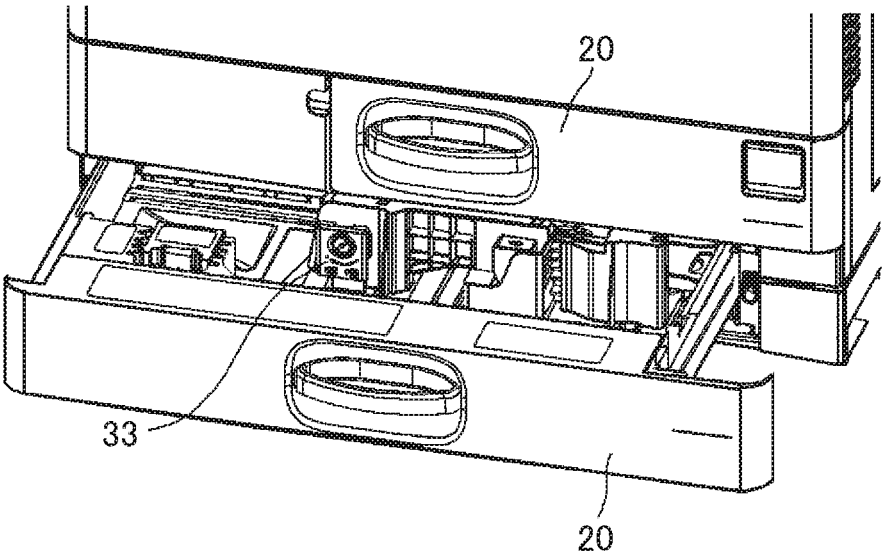

FIGS. 12A and 12B are perspective views illustrating a position in which the securing member is held in the image forming apparatus 1000. As illustrated in FIGS. 12A and 12B, when the sheet feeding tray 20 housed in the image forming apparatus 1000 is pulled, the securing member 33 can be visually recognized from the direction in which the sheet feeding tray 20 is pulled. Accordingly, the securing member 33 can be easily recognized and attached or detached. Thus, it is possible to enhance both secure storage and ease of use.

In the present embodiment, "paper sheets" are not limited to ones made of paper, but include ones referred to as a recorded medium, a recording medium, recording paper, and a recording paper sheet. In addition, image formation, recording, and printing are regarded as synonymous.

This disclosure has been described above in detail based on the embodiment. The embodiment is merely an example, and various modifications can be made without departing from the gist of this disclosure. For example, the embodiment, variations, and advantageous configurations may be combined. The securing member 33 may be used to secure the side fence 28 to the device body 22. Furthermore, the image forming apparatus 1000 including the sheet loading device according to this disclosure is not limited to a copying machine or a printer, but may be a facsimile machine or a multifunction peripheral having a plurality of functions.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet loading device comprising:

a device body to load a sheet;

a guide disposed extending in a sheet conveying direction in the device body;

a restricting body to move along the guide of the device body and to restrict a position of an end portion of the sheet; and a securing body extending perpendicularly from the restricting body to attach to the restricting body and the guide and detach from the restricting body and the guide, the securing body having an engaging body, the engaging body of the securing body engaging with the guide at an arbitrary position on the guide in the sheet conveying direction, the restricting body being secured to the device body according to engagement of the engaging body of the securing body with the guide of the device body, wherein the securing body includes a rotatable switching body to rotate the engaging body relative to the securing body, wherein in a first position the engaging body is in a position parrallel to the sheet conveying direction of the guide and in a second position the engaging body is orthogonal to the guide.

2. The sheet loading device according to claim 1, wherein the securing body and the restricting body include at least a set of an engagement pin and an engagement opening corresponding to each other, and wherein the engagement opening has clearance via which the engagement pin moves in a direction of the guide.

3. The sheet loading device according to claim 1, wherein the switching body includes a click mechanism to generate a click feeling when a state of the engaging body is changed from a released state to a secured state and when the state of the engaging body is changed from the secured state to the released state.

4. The sheet loading device according to claim 1, wherein the securing body includes a mark to determine whether the engaging body is in one of a secured state and a released state.

5. The sheet loading device according to claim 1, wherein the switching body includes at least one of a knurled portion, a crossed groove, and a coin groove.

6. The sheet loading device according to claim 1, further comprising:

a bottom plate to move in a vertical direction and move the sheet in the vertical direction, wherein an upper surface of the securing body protrudes in the vertical direction from the bottom plate in a range of 0 mm to 2 mm.

7. The sheet loading device according to claim 1, wherein the securing body is detachably attached in the sheet loading device.

8. The sheet loading device according to claim 7, wherein the securing body is detachably attached to a side in a direction in which the sheet loading device is pulled.

9. The sheet loading device according to claim 7, further comprising:

another restricting body movable in a direction perpendicular to the restricting body and in which the sheet loading device is pulled, wherein the securing body is detachably attachable to said another restricting body.

10. The sheet loading device according to claim 7, wherein the securing body is held at a position where the securing body is visually recognized from a direction in which the sheet loading device is pulled.

11. An image forming apparatus comprising: the sheet loading device according to claim 1.

12. A sheet loading device comprising:

a device body to load a sheet;

a guide disposed extending in a sheet conveying direction in the device body;

an engagement target body disposed separately from the guide in the device body and extending in parallel with the guide in the sheet conveying direction;

a restricting body to move along the guide of the device body and to restrict a position of an end portion of the sheet; and a securing body extending perpendicularly from the restricting body to attach to the restricting body and the guide and detach from the restricting body and the guide, the securing body having an engaging body, the engaging body of the securing body engaging with the engagement target body at an arbitrary position on the engagement target body in the sheet conveying direction, the restricting body being secured to the device body according to engagement of the engaging body of the securing body with the engagement target body of the device body, wherein the securing body includes a rotatable switching body to rotate the engaging body relative to the securing body, wherein in a first position the engaging body is in a position parallel to the sheet conveying direction of the guide and in a second position the engaging body is orthogonal to the guide.

13. The sheet loading device according to claim 12, wherein the securing body and the restricting body include at least a set of an engagement pin and an engagement opening corresponding to each other, and wherein the engagement opening has clearance via which the engagement pin moves toward the guide.

14. An image forming apparatus comprising the sheet loading device according to claim 12.

15. A sheet loading device comprising:

a device body to load a sheet;

a guide disposed extending in a sheet conveying direction in the device body;

a restricting body to move along the guide of the device body and to restrict a position of an end portion of the sheet;

a securing body extending perpendicularly from the restricting body to attach to the sheet loading device and detach from the sheet loading device, the securing body having a first engaging body and a second engaging body;

a first engagement target body configured to engage with the first engaging body of the securing body; and a second engagement target body configured to engage with the second engaging body of the securing body, the securing body being held by the first engagement target body and the second engagement target body in a first state, the device body including a third engagement target body to engage with the first engaging body of the securing body, the restricting body including a fourth engagement target body to engage with the second engaging body of the securing body, the first engaging body of the securing body engaging with the third engagement target body and the second engaging body of the securing body engaging with the fourth engagement target body in a second state, the restricting body being secured to the device body at an arbitrary position on the guide according to engagement of the securing body and the device body, wherein the securing body includes a rotatable switching body to rotate the second engaging body relative to the securing body, wherein in a first position the engaging body is in a position parallel to the sheet conveying direction of the guide and in a second position the engaging body is orthogonal to the guide.

16. The sheet loading device according to claim 15, wherein a position of the second engagement target body relative to the first engagement target body is identical to a position of the fourth engagement target body relative to the third engagement target body, in the sheet loading device.

17. The sheet loading device according to claim 15, further comprising:

another restricting body to restrict an end position of the sheet in a position different from the restricting body, wherein said another restricting body includes the first engagement target body and the second engagement target body.

18. An image forming apparatus comprising the sheet loading device according to claim 15.

* * * * *